United States Patent [19]

Komorowski et al.

[11] Patent Number: 4,705,477

[45] Date of Patent: Nov. 10, 1987

[54] SIMULATION OF AERIAL DECOY ARRANGEMENTS

[75] Inventors: Robert B. Komorowski, Fareham; Mark Else, Portchester, both of England

[73] Assignee: Plessey Overseas Limited, Illford, England

[21] Appl. No.: 747,183

[22] Filed: Jun. 21, 1985

[30] Foreign Application Priority Data

Jun. 23, 1984 [GB] United Kingdom ..... 8416083

[51] Int. Cl.[4] ..... G06G 7/80; F41F 27/00

[52] U.S. Cl. ..... 434/24; 434/15; 364/578

[58] Field of Search ..... 89/1.56, 1.11, 1.6, 89/1.55; 434/11, 12, 14, 15, 16, 19, 24; 73/167; 102/355; 364/578; 235/408

[56] References Cited

U.S. PATENT DOCUMENTS

| | | | |
|---|---|---|---|
| 2,696,605 | 12/1954 | Knickerbocker | 73/167 |
| 2,719,366 | 10/1955 | Schmitt et al. | 434/15 |
| 3,337,874 | 8/1967 | Morgan | 434/15 |
| 4,485,669 | 12/1984 | Schmitt | 73/167 |
| 4,541,804 | 9/1985 | Armour et al. | 434/15 |

OTHER PUBLICATIONS

Hartman, Super Realistic Combat Training for B-52 EWO's, 9/1980, pp. 83-84 and 86.

*Primary Examiner*—Stephen C. Bentley
*Assistant Examiner*—Stephen M. Johnson
*Attorney, Agent, or Firm*—Fleit, Jacobson, Cohn & Price

[57] ABSTRACT

A launching barrel/oscillator module simulation unit is provided for simulating a plurality of launcher barrels and associated oscillator module of an aerial (infra-red or chaff) decoy arrangement. The unit is adapted for connection to a launcher control module (LCM) of the arrangement which sends command information over a data link (DB) for the operation of the launcher/barrel oscillator module (LCM) in accordance with specific decoy requirements. The unit is effective for sending status information back to the launcher control module (LCM) over the data link (DB) and basically comprises (i) a plurality of switches in respect of each simulated barrel and operable in dependence upon the condition (e.g. loaded or unloaded) of the barrel to be simulated (ii) selector switching means for the selective application of simulated firing and/or charge and timing pulses to simulated inductive coupling means of the respective barrels (iii) a plurality of digital display indicators appertaining to the respective barrels and effective for displaying the predetermined time intervals corresponding to the aforesaid timing pulses and (iv) further switching means for simulating various conditions (e.g. misfire) of the launcher barrel/oscillator module and various indicator lamps for providing visual indications relating to pre-set and monitoring functions.

3 Claims, 6 Drawing Figures

| S1 | S2 | S3 | BARREL STATUS |
|---|---|---|---|
| 0 | 0 | 0 | BARREL EMPTY |
| 1 | 0 | 0 | CHAFF LOADED |
| 1 | 1 | 0 | I.R. LOADED |
| 1 | 1 | 1 | I.R. LAUNCHING |

FIG. 4.

| ROTENOID SENSE FIELD | | | INDUCTIVE COUPLING CONNECTED |
|---|---|---|---|
| 0 | 0 | 1 | SIGNAL A |
| 0 | 1 | 0 | POWER A |
| 0 | 1 | 1 | SIGNAL B |
| 1 | 0 | 0 | POWER B |
| 1 | 0 | 1 | SIGNAL C |
| 1 | 1 | 0 | POWER C |

FIG. 5.

SIMULATION OF AERIAL DECOY ARRANGEMENTS

BACKGROUND OF THE INVENTION

This invention relates to aerial decoy arrangements for the protection of potential targets (e.g. ships) against radar-controlled or heat-seeking missiles.

In the case of radar decoy arrangements, chaff-dispensing rockets may be used to dispense their chaff pay-loads at a predetermined time interval after rocket launch to provide an appropriately positioned aerial chaff cloud which is capable of producing a radar echo comparable to the potential target.

For the decoy of heat-seeking missiles, rockets or mortars may be used to provide at predetermined time intervals after launch an aerial infra-red display pattern intended to divert an approaching missile away from a potential target and towards the infra-red display. The infra-red mortar decoy arrangement may utilize multi-mortar packs the mortars of which are arranged to be fired in rapid succession to produce a progressively developing infra-red display pattern.

In the aforesaid decoy arrangements, the chaff or infra-red rockets or mortars, as the case may be, may be arranged to be launched from the barrels of a multi-barrel launcher in response to the application of firing pulses to an inductive coupling arrangement having the respective parts thereof (i.e. primary and secondary) embodied in the base of the launcher barrel and the rear end of the chaff-filled or infra-red rocket or mortar (multi-mortar pack).

In the case of mortars, it may be arranged that a pyrotechnic fuse ignited at launch of the mortar causes the mortar pay-load (e.g. infra-red) to be discharged or dispensed after a predetermined time interval from launch dependent upon the "fuse time". Alternatively, the mortar may embody a simple battery-powered electric timing circuit which may be pre-set to provide an electrical output for initiating the dispensing of the mortar pay-load at an appropriate time interval following launch.

However, in the case of chaff-dispensing rockets, it may be arranged that the rocket embodies power storage means and a variable timing circuit arrangement. The power storage means may comprise capacitor means which is arranged to be charged in response to a charging pulse of relatively high frequency applied to the inductive coupling prior to the application of the previously mentioned firing pulse. The power stored in the capacitor means is utilized to render the variable timing circuit arrangement effective to respond to the previously mentioned timing pulses which will be of the same frequency as the charging pulse and which are also applied to the rocket through the inductive coupling. These timing pulses operate a counter for pre-setting the time interval between launch of the rocket and the initiation of the chaff-dispensing operation. The stored power produces a count down operation in the timing circuit consequent upon the launch of the rocket and also powers the initiation of the chaff-dispensing operation.

In order to monitor the firing and launching of the rockets or mortars from the launcher barrels, each of the barrels which are usually conveniently arranged in groups of three may be provided with switches the conditions of which indicate the unloaded or loaded condition of the appertaining barrels and also serve to indicate the launch of each mortar of a multi-mortar pack. The inductive coupling primaries of the barrels of each group may be supplied with pulses (e.g. firing, charge and timing pulses) and the barrels monitored through a selector switch which may be controlled to step from one barrel to another as required.

The firing pulses and, where appropriate, the charge and timing pulses, for each group of barrels may be derived from an oscillator module appertaining to the group of barrels in response to data fed from a launcher control module which also monitors the operation of the launcher barrels as status information is fed back thereto.

For the purpose of monitoring the launcher control module control outputs without the necessity of actually providing launcher barrels and oscillator modules and without actually loading the barrels with rockets or mortars and firing the latter, the present invention provides a launching barrel/oscillator module simulation unit.

SUMMARY OF THE INVENTION

According to the present invention there is provided a launching barrel/oscillator module simulation unit for simulating a plurality of launcher barrels and associated oscillator module of an aerial decoy arrangement of the form described, said unit being adapted for connection to a launcher control module of said arrangement which sends command information over a data link for the operation of the launcher barrel/oscillator module in accordance with specific decoy requirements, and said unit being effective for sending status information back to the launcher control module over said data link, the simulation unit comprising a plurality of switches in respect of each simulated barrel and operable in dependence upon the condition (e.g. loaded or unloaded) of the barrel to be simulated, selector switching means for the selective application of simulated firing and/or charge and timing pulses to simulated inductive coupling means of the respective barrels, a plurality of digital display indicators appertaining to the respective barrels and effective for displaying the predetermined time intervals corresponding to the aforesaid timing pulses and further switching means for simulating various conditions (e.g. misfire) of the launcher barrel/oscillator module and various indicator lamps for providing visual indications relating to pre-set and monitoring functions.

A number of simulation units each of which simulates a plurality (e.g. three) of launcher barrels with an associated oscillator module may be connected in common to the launcher control module over the data link referred to. In this case the command information (words) from the launcher control module will include simulation unit identifying data (address code) to which the appropriate simulation unit will respond.

BRIEF DESCRIPTION OF THE DRAWINGS

By way of example the present invention will now be described with reference to the accompanying drawings in which:

FIG. 4 shows a table of the simulated barrel status switch conditions of the simulation unit;

FIG. 5 shows a table of the positions of the selector switch for producing simulated charge and timing and firing conditions; and, FIG. 6 is a diagram which shows exemplary formats of "command" and "status" words which are respectively applied to and received from the simulation unit.

DETAILED DESCRIPTION OF THE PREFERRED EMBODIMENT

Figure 1:
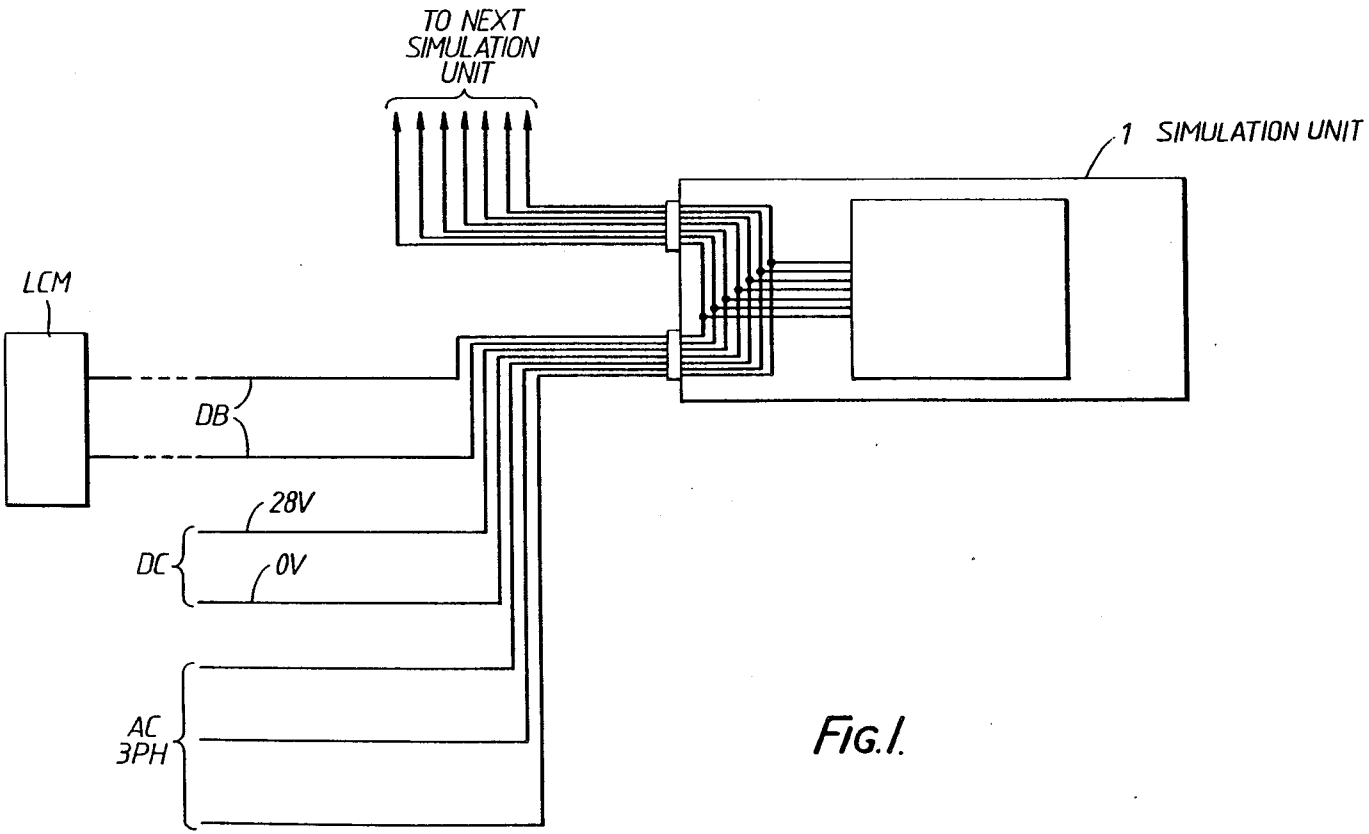
FIG. 1 is a schematic block diagram of a rocket/mortar launcher barrel/oscillator module simulation unit.
Figure 6:
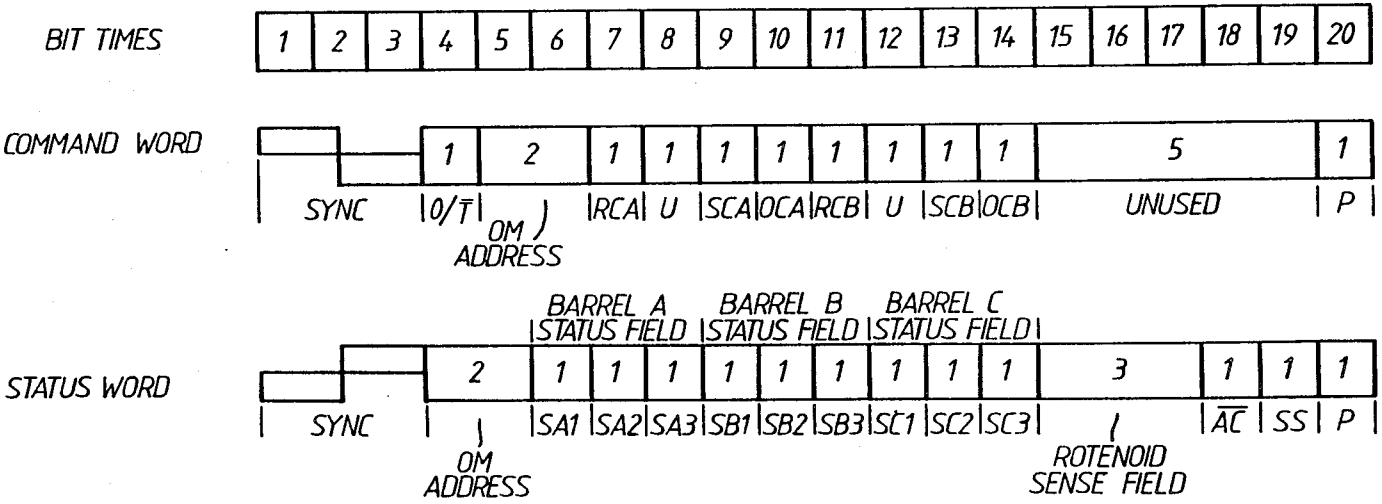

Referring to FIG. 1 of the drawings one of a number of launcher barrel/oscillator module simulation units according to the invention is represented by the block 1 and, more specifically, this unit basically simulates a group of three rocket or mortar launcher barrels including inductive coupling primaries and a common oscillator module and selector switch means for selectively controlling/monitoring the respective launching barrels of the group. This oscillator module inter alia converts power charging, timing and firing data received from a launcher control module LCM into corresponding high frequency pulses for selective transmission via the selector switch and the appertaining inductive coupling to a rocket or mortar pack loaded into each of the launcher barrels. This pulse information, together with information for identifying the particular simulation unit to be controlled in the case of a plurality of such units effectively connected in common with the launcher control module, and information for identifying a particular launcher barrel within a group of three barrels simulated by a simulation unit, will be embodied in "command" words transmitted to the simulation units over the data bus DB. In response to these "command" words, the general format of one such word being indicated in FIG. 6, where the OPERATIONAL/TEST (O/T), ROTENOID CONTROL SELECTOR SWITCH CONTROL PULSES (RCA, RCB), UNUSED (U), SUPPLY CONTROL FIRING PULSES (SCA, SCB) and OSCILLATOR CONTROL CHARGING AND TIMING PULSES (OCA, OCB) are set forth. The particular simulation unit addressed by the "command" word will immediately send a "status" word (See FIG. 6), with BARREL SWITCHES controlling the CHAFF (SA1, SB1, SC1), INFRA-RED (SA2, SB2, SC2), LAUNCH SCASC (SA3, SB3, SC3), ALL CLEAR TEST LIST TO LCM (AC), SIGNAL SENSE (SS), and PARITY (P), back to the launcher control module LCM for monitoring purposes.

Figure 2:
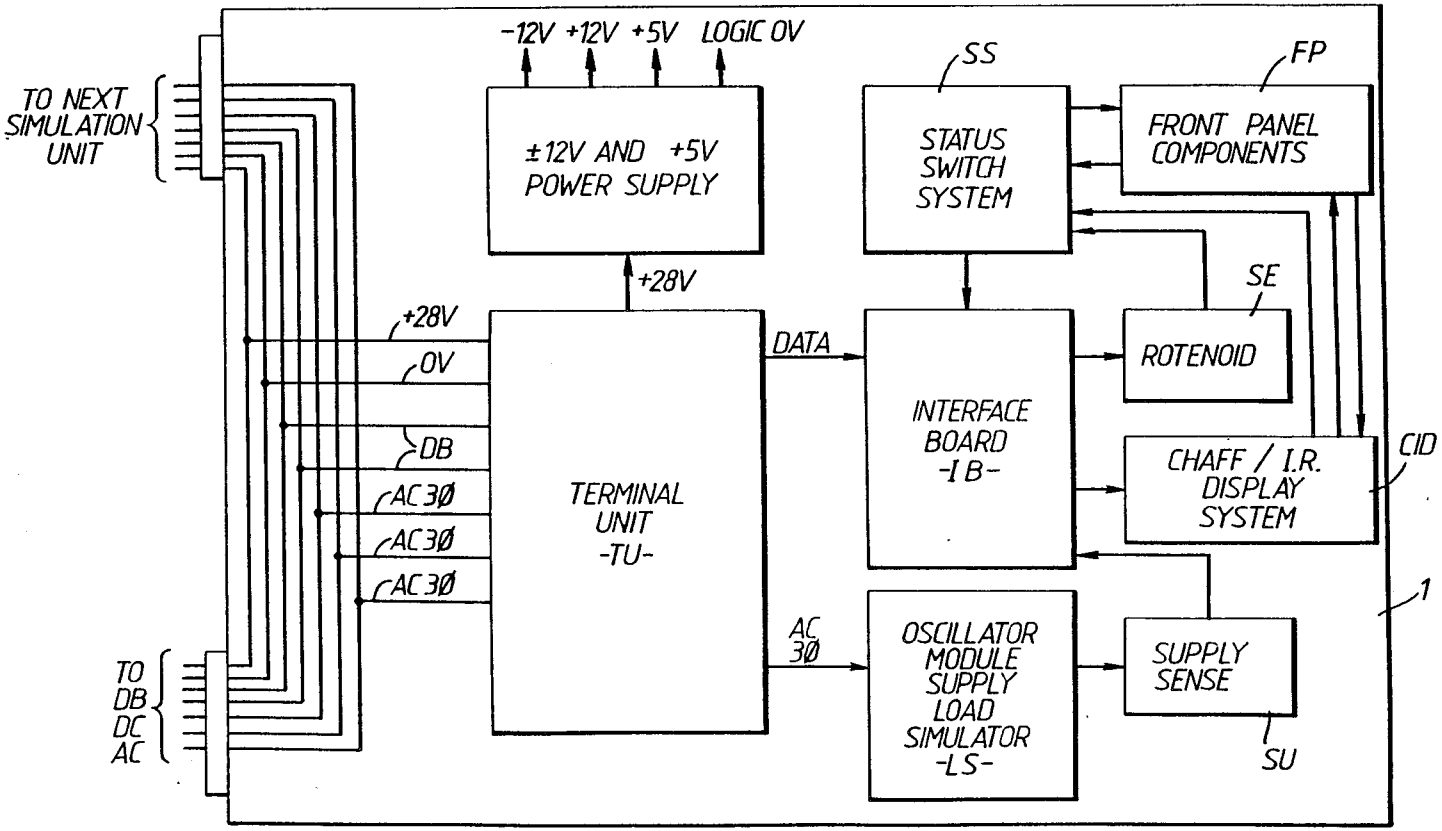
FIG. 2 is a schematic block diagram showing the various parts of the simulation unit of FIG. 1.

As can be seen in FIGS. 1 and 2, the inputs to each simulation unit comprise a three-phase AC supply as well as DC inputs 0 V and 28 V. These inputs together with the data bus DB are coupled to a terminal unit TU. The three-phase AC supply is applied by the terminal unit TU to an oscillator module supply load similator LS. This simulator LS simulates the load on the AC supply normally presented by the oscillator module and operation of the simulator LS will be controlled by the "command" words received over the data bus DB. The status of the oscillator load simulator LS is monitored by a supply sense unit SU which provides an interface board IB with information regarding the status of the oscillator module high voltage supply. The interface board IB receives appropriate "command" words from the terminal unit TU and full status information relating to the launcher barrel/oscillator module fed to the board IB from launching barrel switches, control panel switches, etc. will be sent back to the launcher control module LCM via the terminal unit TU over the data bus DB.

Figure 3:
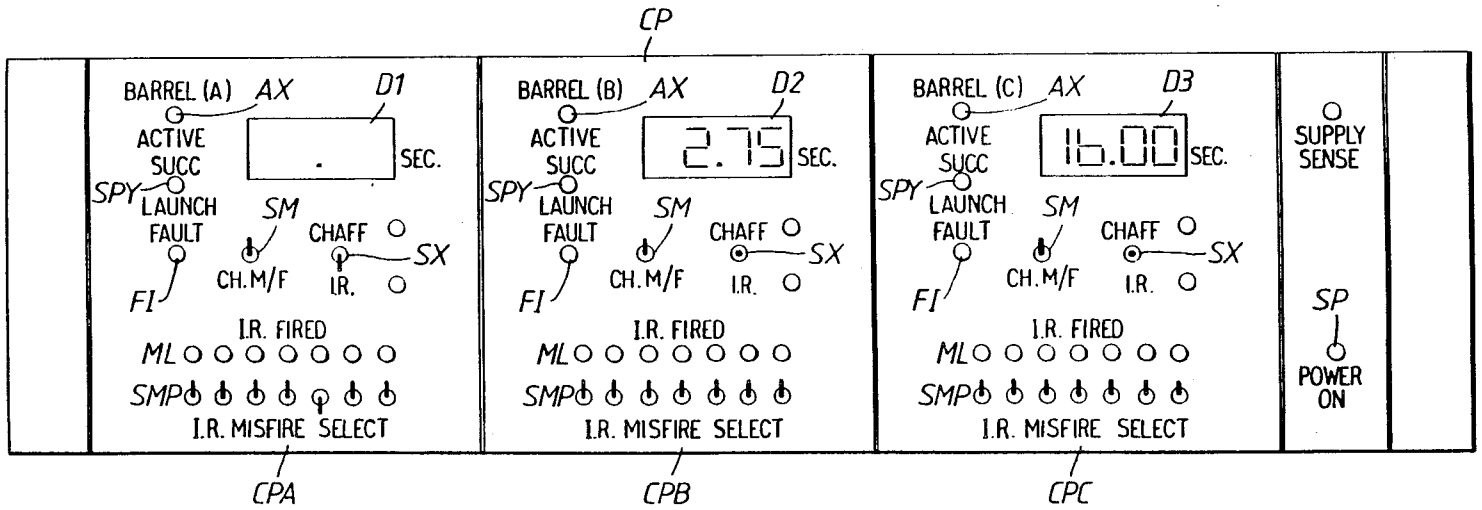
FIG. 3 shows a front view of a control panel of the simulator unit of FIGS. 1 and 2.

As previously mentioned each of the rocket/mortar launcher barrels has three status switches associated with it and the condition of these switches indicates the state of the barrels (e.g. loaded, unloaded, or successful launch of mortar of a multi-mortar pack) these switches are simulated electronically by a status switch system SS of the simulation unit 1 and the conditions of the switches of system SS will vary in dependence upon conditions pre-set by the operation of various switch controls on the simulation unit control panel shown in FIG. 3. This control panel embodies a chaff/IR display system CID and the front panel components FP. As can be seen from FIG. 3, the simulation unit control panel CP comprises three sections CPA, CPB and CPC appertaining to respective simulated launcher barrels A, B and C. Each control panel section includes a switch SX which, after switching on the simulation unit 1 by the operation of a switch SP, can be operated to a position simulating loading of the appertaining launcher barrel with a chaff-filled rocket (position "chaff") or a multi-mortar pack (position "IR") consisting of seven infra red mortars contained within a single multi-mortar pack.

Misfire conditions of each of the loaded barrels can be simulated by the operation of a chaff-filled rocket misfire switch SM or by the operation of one or more of the seven infra-red mortar misfire switches SMP.

The previously mentioned "command" words received by the pre-set simulation unit will, in the case of chaff-filled rocket control operations include data relating to the requisite time intervals between launch of the chaff rockets concerned and the dispensing of their chaff pay-loads. This data will produce operation of digital display devices D1, D2 and D3 on the control panel sections CPA, CPB and CPC to indicate the launch-to-dispense time intervals appertaining to the rockets loaded into the simulated barrels A, B and C as the selector switch switches in turn to the simulated barrels. The active barrel indicator lights AX (e.g. LED's) will be energized in accordance with the position of the selector switch SE. If a chaff-filled rocket misfire function has been preset into the simulation unit control panel CP then a fault indicator light FI will be energised after the firing pulse has been delivered to the simulated barrel. Consequently, the successful launch light SPY will not be energized.

In the case of simulated mortar firing, as the seven mortars of the multi-mortar pack are launched in rapid succession the indicator lights ML will be energized in turn but if a mortar misfire switch SMP has been operated then the appertaining indicator light ML will remain de-energized.

By referring to FIG. 4 it can be seen that the status of each simulated barrel of the group of three barrels is indicated by the condition (0 or 1) of the three switches S1, S2 and S3 (e.g. switches SA1, SA2 and SA3 relating to barrel A). In the case of launch of an infra-red mortar the indicated switch conditions 111 obtain only momentarily at the time when the infra-red mortar is launched. This barrel status data as pre-set by the operation of appropriate controls of the simulation unit control panel CP will be passed back to the launcher control module LCM over the data bus DB in response to receipt of a suitably addressed "command" word from the launcher control module.

Since charge and timing pulses are required for chaff-filled rockets but not for infra-red mortars the selector switch SE is operatively controlled whereby in the case of chaff-rocket loading of the simulated barrels the inductive couplings of the barrels A, B and C have signals signal A, signal B and signal C corresponding to charge and timing pulses applied to them followed by signals power A, power B and power C corresponding to firing pulses. When the simulated barrels are loaded with mortar packs the selector switch SE will be controlled so that signals power A, power B and power C only, corresponding to the firing pulses, will be applied to the inductive couplings of the simulated barrels. This procedure can be seen from the table shown in FIG. 5 of the accompanying drawings.

What is claimed is:

1. A launching barrel/oscillator module simulation unit for simulating a plurality of launcher barrels and associated oscillator module of an aerial decoy arrangement, said launching barrel/oscillator module simulation unit when in use being connected to a launcher control module of aerial decoy arrangement which sends command information over a data link for the operation of said launcher barrel/oscillator module simulation unit in accordance with specific decoy requirements, said launching barrel/oscillator module simulation unit comprising:

means for sending status information back to the launcher control module over said data link;

a plurality of switches in respect of each simulated launcher barrel and operable in dependence upon conditions of loaded and unloaded of the simulated launcher barrel to be simulated;

selector switching means for the selective application of simulated pulses of firing, charge and timing pulses to the appropriate simulated launcher barrels;

a plurality of digital display indicators appertaining to the appropriate simulated launcher barrels and effective for displaying predetermined time intervals corresponding to simulated timing pulses and;

further switching means for simulating conditions of misfire of the launcher barrel/oscillator module and various indicator lamps for providing visual indications relating to pre-set and monitoring functions.

2. A launching barrel/oscillator module simulation unit as claimed in claim 1, comprising a terminal unit connected to a launcher control module via data bus means, an oscillator module supply load simulator controlled from the launcher control module and arranged to be monitored by a supply sense unit, and interface board means arranged to receive command data from the terminal unit and to receive status information from launching barrel switches, control panel switches for transmission back to the launcher control module over the data bus means.

3. A launching barrel/oscillator module simulation unit as claimed in claim 1, in which the launching barrel/oscillator module simulation unit comprises a control panel having control switches and indicator lamps appertaining to pre-setting and monitoring functions of the launching barrel/oscillator module simulation unit.

* * * * *